US009233742B2

(12) United States Patent
Kuo

(10) Patent No.: US 9,233,742 B2
(45) Date of Patent: Jan. 12, 2016

(54) FASTENING BUCKLE FOR SNORKEL

(71) Applicant: Yen-Ting Kuo, Hsin Kang Township, Chiayi County (TW)

(72) Inventor: Yen-Ting Kuo, Hsin Kang Township, Chiayi County (TW)

(73) Assignee: Shine Ball Enterprise Co., Ltd., Hsin Kang Township (TW)

( * ) Notice: Subject to any disclaimer, the term of this patent is extended or adjusted under 35 U.S.C. 154(b) by 80 days.

(21) Appl. No.: 14/084,656

(22) Filed: Nov. 20, 2013

(65) Prior Publication Data

US 2015/0135482 A1 May 21, 2015

(51) Int. Cl.
*A44B 6/00* (2006.01)
*B63C 11/20* (2006.01)

(52) U.S. Cl.
CPC ..... *B63C 11/205* (2013.01); *Y10T 24/13* (2015.01); *Y10T 24/1394* (2015.01)

(58) Field of Classification Search
CPC ... Y10T 24/1394; A44B 99/00; B63C 11/205
See application file for complete search history.

(56) References Cited

U.S. PATENT DOCUMENTS 5,730,342 A * 3/1998 Tien ..... 224/271
5,906,031 A * 5/1999 Jensen ..... 24/3.12
6,318,610 B1 * 11/2001 Doherty ..... 224/271
6,438,808 B1 * 8/2002 Kung ..... 24/572.1
6,736,136 B2 * 5/2004 Chen-Lieh ..... 128/201.11
7,222,621 B1 * 5/2007 Wung ..... 128/201.27
8,156,616 B2 * 4/2012 Lo ..... 24/516
8,806,726 B1 * 8/2014 Lo ..... 24/516
2004/0003809 A1 * 1/2004 Pan ..... 128/201.11
2004/0079365 A1 * 4/2004 Sato ..... 128/201.11
2005/0097709 A1 * 5/2005 Chen ..... 24/3.12
2005/0274380 A1 * 12/2005 Shiue ..... 128/201.11
2010/0031481 A1 * 2/2010 Lo ..... 24/499
2012/0036682 A1 * 2/2012 Lo ..... 24/3.12

* cited by examiner

*Primary Examiner* — Robert J Sandy
*Assistant Examiner* — Matthew Sullivan
(74) *Attorney, Agent, or Firm* — Alan D. Kamrath; Kamrath IP Lawfirm, P.A.

(57) ABSTRACT

A fastening buckle for fastening a snorkel to swimming goggles includes a strip-holding member and a snorkel-holding member. The strip-holding member has a resiliently depressible hanging section and has an outer surface formed with an inclined plane. The snorkel-holding member has a gripping portion laterally formed with a socket for receiving the hanging section of the strip-holding member. The socket has an outer wall formed with a cut-away section for abutting against a bottom edge of the hanging section. The socket further has a resiliently depressible pressing button extending downward from a top thereof to hang over the cut-away section and abut against the inclined plane of the hanging section. When pressed, the pressing button presses the inclined plane to expel the hanging section downward from the cut-away section, allowing convenient disengagement between the snorkel-holding member and the strip-holding member.

2 Claims, 7 Drawing Sheets

FASTENING BUCKLE FOR SNORKEL

BACKGROUND OF THE INVENTION

1. Technical Field

The present invention relates to a fastening buckle for fastening a snorkel to a head strip of swimming goggles (diving goggles). The fastening buckle has a snorkel-holding member for gripping the snorkel. The snorkel-holding member is provided with a socket for allowing a head portion of a strip-holding member to be inserted thereto. The socket has an outer wall formed with a cut-away section and a resiliently depressible pressing button hangs over the cut-away section. A hanging section formed on the head portion of the strip-holding member for being received in the cut-away section is provided with an inclined plane that is configured to be pressed by the pressing button. When the inclined plane is pressed by the pressing button, the hanging section is smoothly expelled from the cut-away section, to achieve easy disengagement between the snorkel-holding member and the strip-holding member.

2. Description of Related Art

Generally, a snorkel for skin diving has a mouthpiece provided at a lower part thereof for a diver to bite and breathe therethrough, and has a fastening buckle at its milled part for fastening the snorkel to a head strip of swimming goggles (diving goggles) worn by the diver. One example of the various existing fastening buckles is shown in FIG. 1 and FIG. 2. The known fastening buckle has a snorkel-holding member 1 for being mounted around a snorkel and a strip-holding member 2 for holding a head strip of swimming goggles (diving goggles). The upper head portion 22 of the strip-holding member 2 is formed as a hanging section 23 with its lower part hanging and resiliently depressible. The strip-holding member 2 has its lower end formed with a collar 21 for the head strip to pass therethrough.

Moreover, the snorkel-holding member 1 has a gripping portion 11 for gripping the snorkel. The gripping portion 11 is laterally provided with a socket 12 for receiving the head portion 22 of the strip-holding member 2. The socket 12 has its outer wall formed with a cut-away section 13 for receiving the hanging section 23, so that the lower end of the hanging section 23 abuts against the bottom edge of the cut-away section 13.

Referring to FIG. 3 as well, for removing the snorkel from the goggles, a user can push the hanging section 23 of the strip-holding member 2 to depress and expel its lower end from the bottom edge of the cut-away section 13 of the snorkel-holding member 1. Then, the snorkel together with the snorkel-holding member 1 can be withdrawn upward from the strip-holding member 2. In operation, the hanging section 23 has to be first pushed inward and then biased downward, so the lower end of the hanging section 23 is able to pass across the bottom edge of the cut-away section 13 before the snorkel-holding member 1 and the strip-holding member 2 are separated smoothly. As the operation involves this two-stage force-exerting operation, it is inconvenient.

Additionally, when a user biases the hanging section 23 downward, if his-her pushing finger comes to a site too close to the bottom edge of the cut-away section 13, the second stage of the force-exerting operation may be hindered from smoothly moving the hanging section 23, or may require enhanced force to bias the hanging section 23 and separate the snorkel-holding member 1 from the strip-holding member 2. However, since the aforementioned operation is usually performed when the goggles and the head strip, and in turn the fastening buckle, are still worn on the user's head, it is common that the user's finger cannot exert force exactly at a perfect site and that the hanging section 23 rebounds, making the lower end of the hanging section 23 again abut against the bottom edge of the cut-away section 13 and leading to difficult disengagement between the snorkel-holding member 1 and the strip-holding member 2. In a case where the user exerts the downward biasing force excessively, the fastening buckle tends to be damaged or have resilience fatigue over time.

BRIEF SUMMARY OF THE INVENTION

For improving the known fastening buckle that involves a difficult disengagement and inconvenient operation, the present invention provides a fastening buckle having a snorkel-holding member that is provided with a pressing button hanging over a cut-away section for receiving a hanging section of a strip-holding member. Thereby, when pressed downward, the pressing button is depressed and has its bottom edge pressing against an inclined plane formed on the hanging section, thereby expelling the hanging section from the cut-away section and in turn making the strip-holding member move downward, to achieve convenient disengagement between the snorkel-holding member and the strip-holding member.

The scheme implemented by the present invention to address the technical issues is a fastening buckle comprising a strip-holding member that has an upper head portion configured to be engaged with a socket provided on a snorkel-holding member. The strip-holding member has the head portion provided with a lower part thereof formed as a hanging section that is resiliently depressible and has a lower outer surface formed with an inclined plane. The snorkel-holding member includes a gripping portion that is laterally formed with the socket for receiving the head portion of the strip-holding member. The socket has an outer wall formed with a cut-away section for abutting against a bottom edge of the hanging section, and a resiliently depressible pressing button extending downward from a top thereof to hang over the cut-away section and abut against the inclined plane of the hanging section.

In the above-described scheme, the strip-holding member further comprises a strip-positioning seat located at a lower end thereof and a pivotable strip-gripping arm located above the strip-positioning seat. The strip-gripping arm has a fork-like lower end that is oppositely provided with two hooked pins facing the strip-positioning seat, and the strip-holding member has a stepped retaining slot formed below the strip-positioning seat for allowing the hooked pins to be inserted and retained therein.

Therefore, when the inclined plane of the hanging section at the head portion of the strip-holding member is pressed by the pressing button of the snorkel-holding member, the hanging section is expelled from the cut-away section, and the strip-holding member is pushed downward synchronously, causing the strip-holding member and the snorkel-holding member to separate completely more easily by one simple pushing operation.

BRIEF DESCRIPTION OF THE DRAWINGS

The invention as well as a preferred mode of use, further objectives and advantages thereof will be best understood by reference to the following detailed description of illustrative embodiments when read in conjunction with the accompanying drawings, wherein.

DETAILED DESCRIPTION OF THE INVENTION

Figure 1:
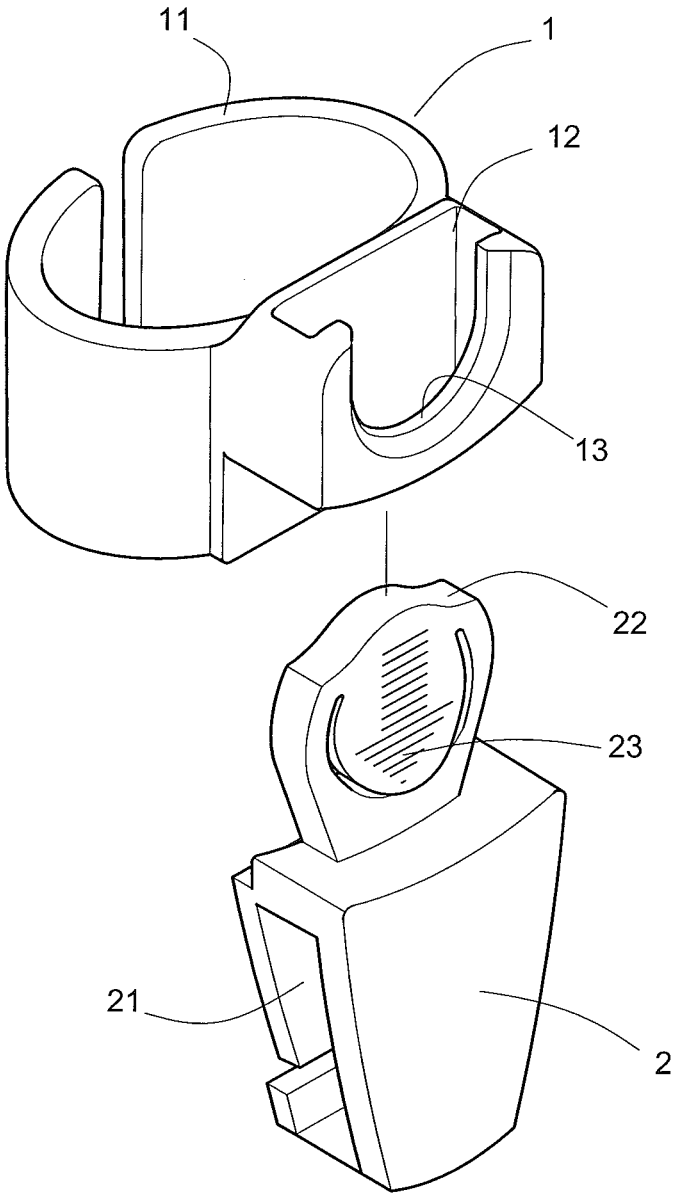
FIG. 1 (PRIOR ART)
FIG. 1 is an exploded view of a known fastening buckle.
Figure 2:
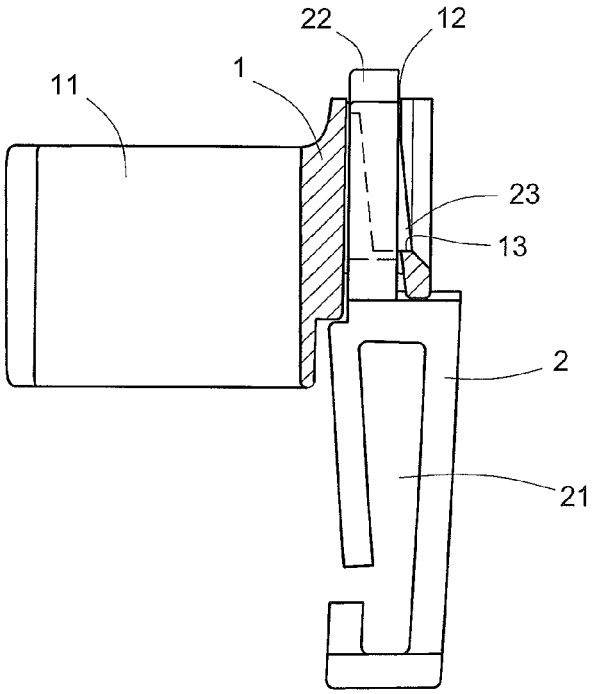
FIG. 2 (PRIOR ART)
FIG. 2 is a lateral, cross-sectional view of the known fastening buckle of FIG. 1.
Figure 3:
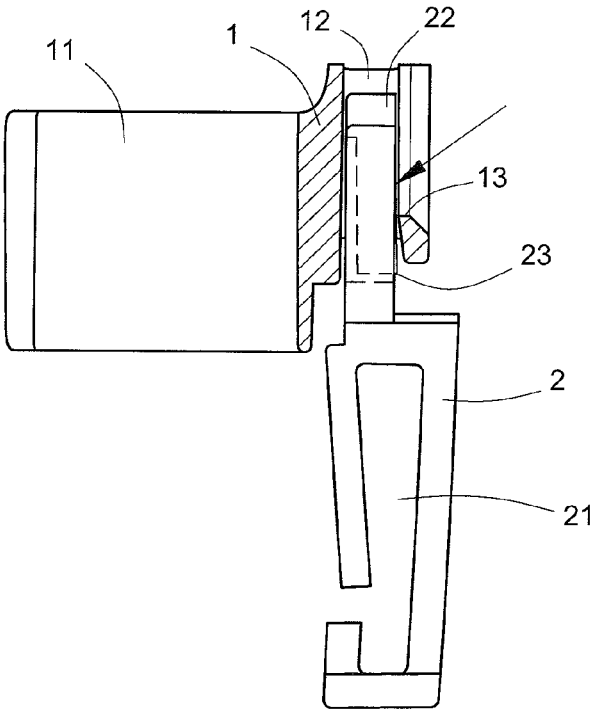
FIG. 3 (PRIOR ART)
FIG. 3 is a lateral, cross-sectional view of the known fastening buckle of FIG. 1 showing its operation.
Figure 4:
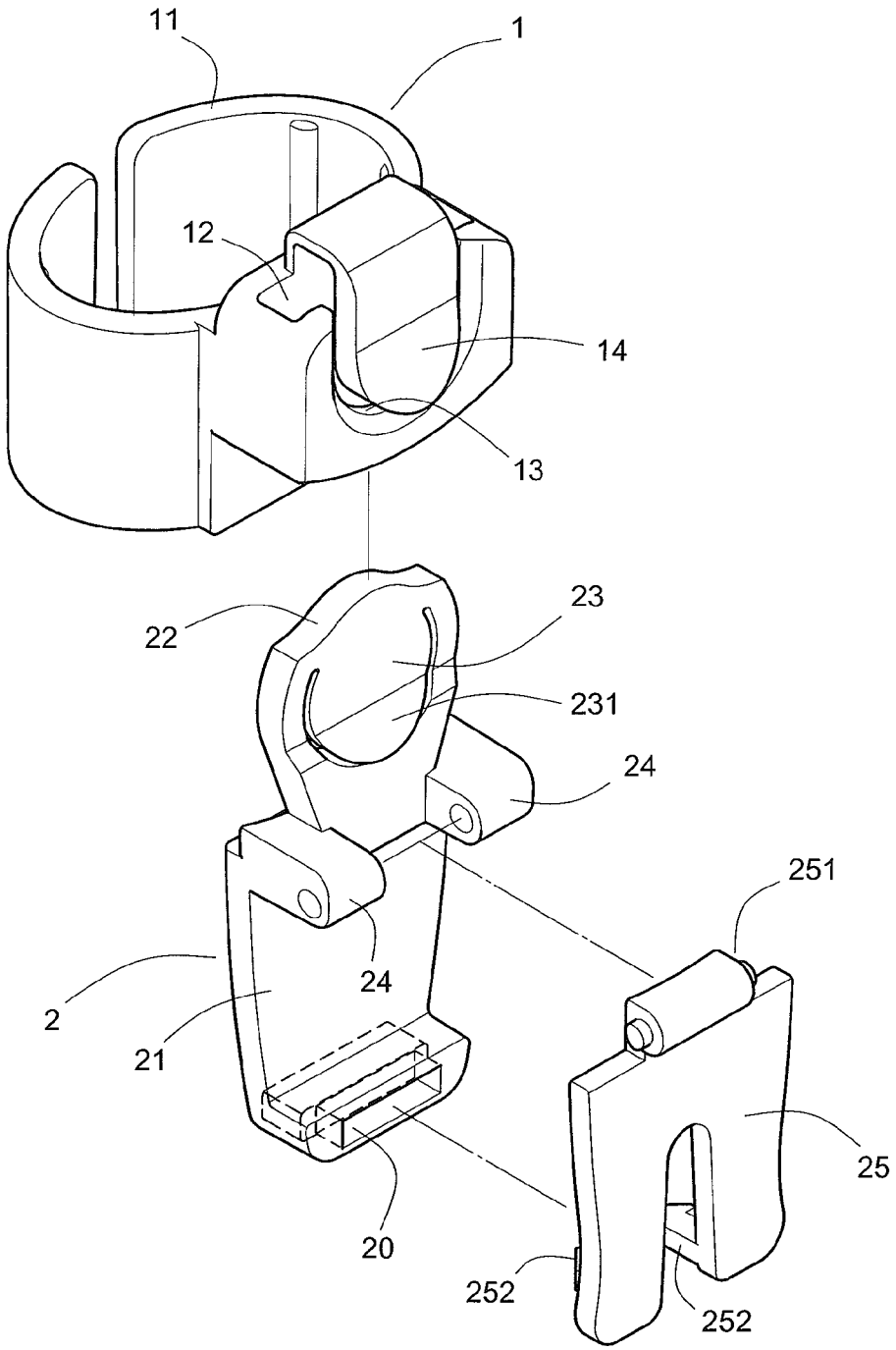
FIGS. 4 and 5 are exploded views of a fastening buckle of the present invention taken from different viewpoints.
Figure 5:
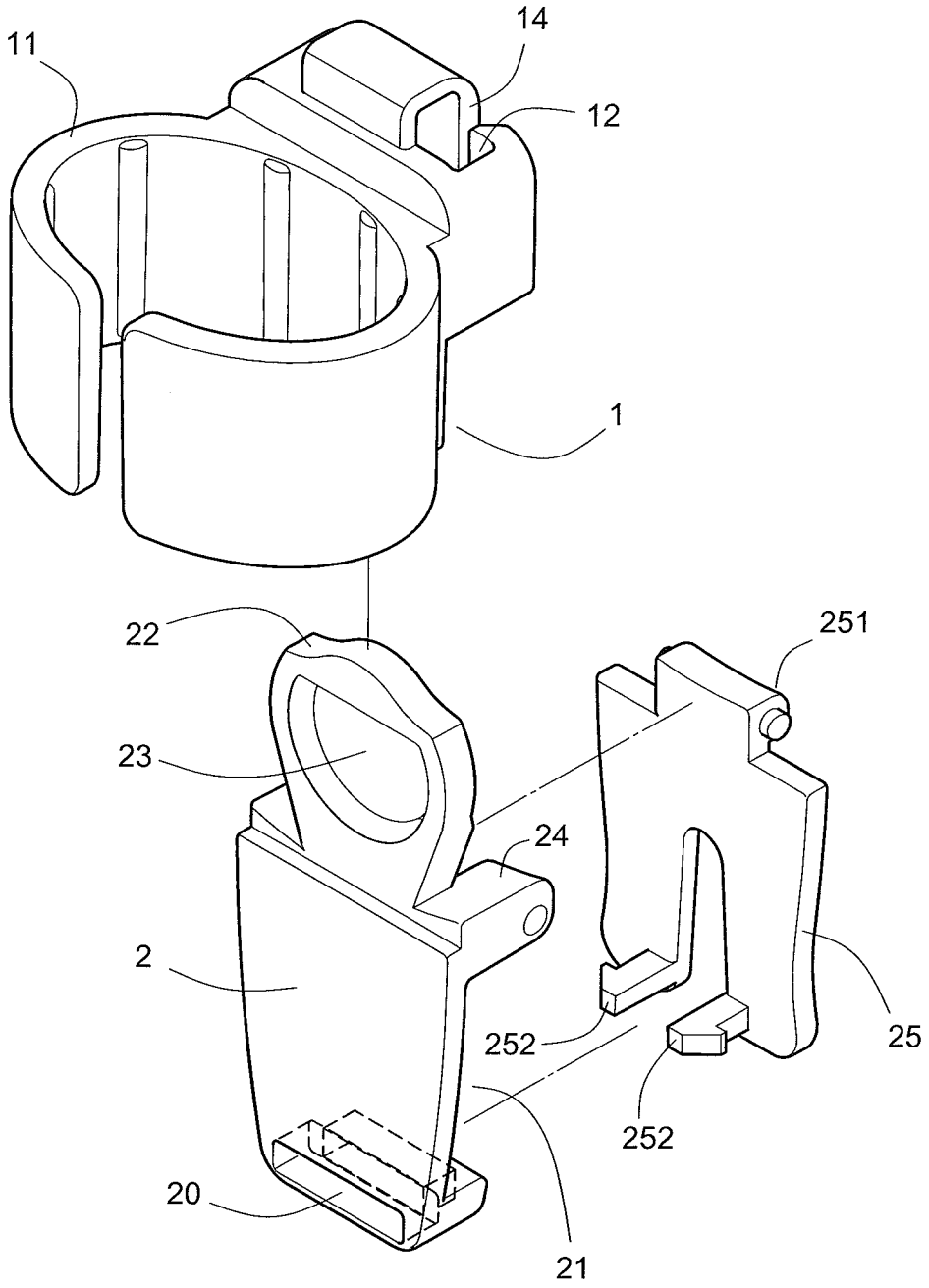
Figure 6:
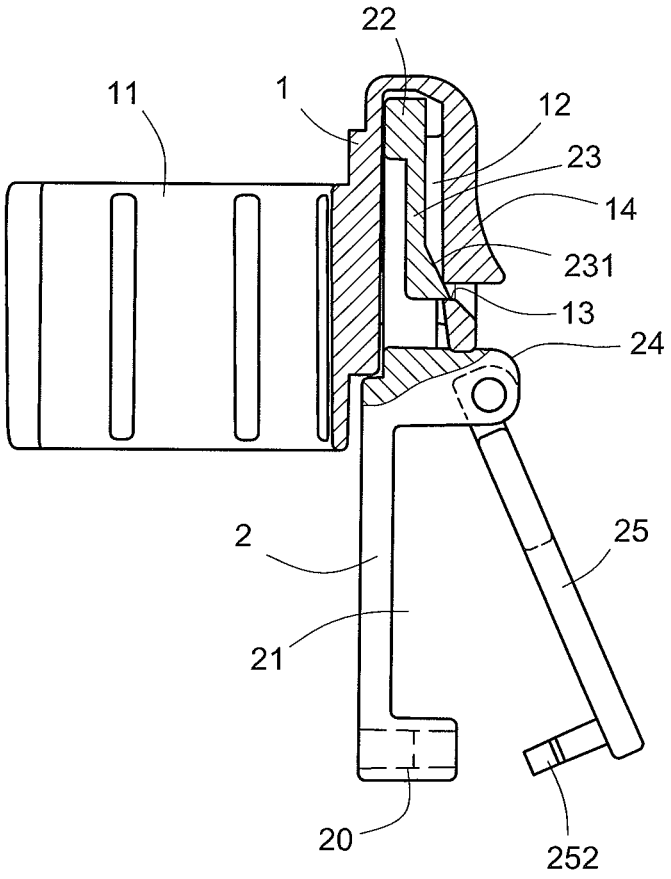
FIG. 6 is a lateral, cross-sectional view of the fastening buckle of FIGS. 4 and 5.

Please refer to FIG. 4 through FIG. 6, according to the present invention, a fastening buckle primarily comprises a snorkel-holding member 1 and a strip-holding member 2 configured to be engaged with each other. The snorkel-holding member 1 has a gripping portion 11 to be mounted around a snorkel (not shown). The gripping portion 11 is laterally provided with a socket 12 for allowing a head portion 22 of the strip-holding member 2 to be inserted therein. The socket 12 has its outer wall formed with a cut-away section 13. A resiliently depressible pressing button 14 extends downward from a top of the socket 12 and hangs over the cut-away section 13.

In addition, at the lower part of the upper head portion 22 of the strip-holding member 2, there is a resiliently depressible hanging section 23. The hanging section 23 has its lower outer surface formed with an inclined plane 231. The strip-holding member 2 has a strip-positioning seat 21 formed at its lower end portion for positioning a head strip of a pair of goggles (not shown). The strip-holding member 2 has a pivot section 24 located above the strip-positioning seat 21. The pivot section 24 is configured to be pivotally engaged with a pivot section 251 provided at an upper end of a strip-gripping arm 25, so that the strip-gripping arm 25 is allowed to swing against the strip-positioning seat 21. The strip-gripping arm 25 has a fork-like lower end portion formed oppositely with two hooked pins 252 facing the strip-positioning seat 21. A stepped retaining slot 20 is formed on the strip-holding member 2 below the strip-positioning seat 21. When the strip-gripping arm 25 swings downward, the hooked pins 252 are retained by the retaining slot 20, thereby holding the head strip in the strip-positioning seat 21 in position. On the contrary, when the two hooked pins 252 of the forked-like lower end portion of the strip-gripping arm 25 are pressed toward each other by a user's two fingers, the two hooked pins 252 retract inward, so the strip-gripping arm 25 is freed and can swing outward, thereby allowing the head strip to be removed from the strip-holding member 2.

Figure 7:
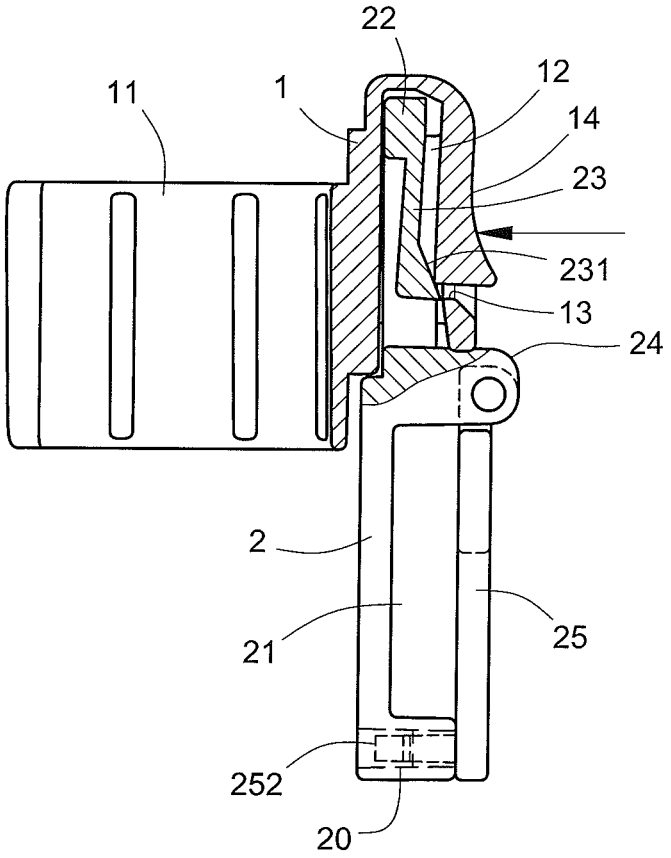
FIGS. 7 and 8 are lateral, cross-sectional views of the fastening buckle of the present invention, showing its operation.
Figure 8:
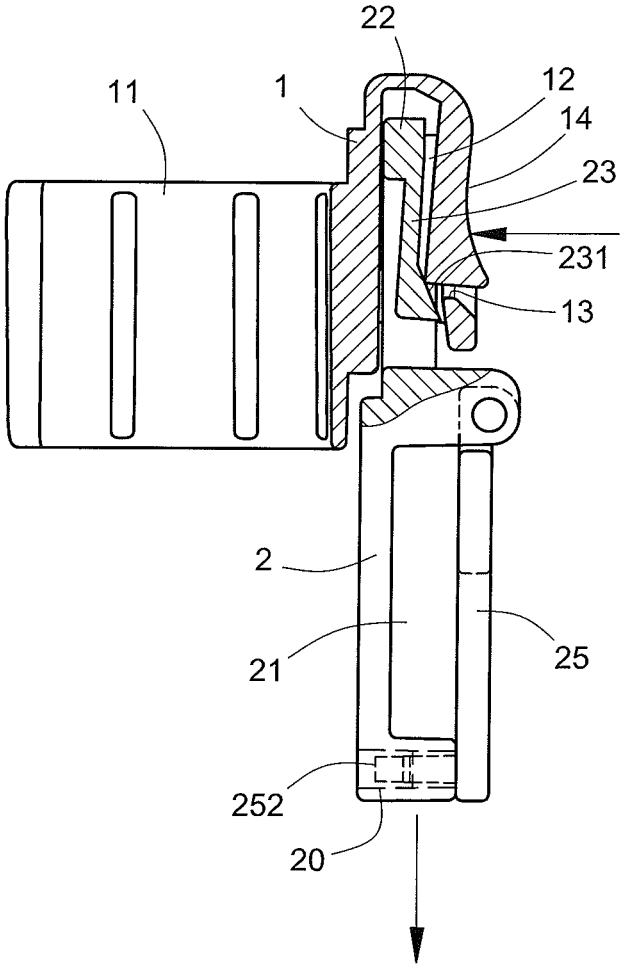

For disengaging the snorkel-holding member 1 and the strip-holding member 2, as shown in FIG. 7, a user may push the pressing button 14 of the snorkel-holding member 1 inward to move the pressing button 14 inward and use its inner bottom edge to press the inclined plane 231 of the hanging section 23 of the strip-holding member 2. The pressing force produces an inward horizontal component and a downward vertical component. The inward horizontal component makes the bottom edge of the hanging section 23 move inward and depart from the bottom edge of the cut-away section 13. At the same time, as shown in FIG. 8, the downward vertical component pushes the entire strip-holding member 2 downward, thereby making the bottom edge of the hanging section 23 further from the cut-away section 13. As a result, the snorkel-holding member 1 and the strip-holding member 2 separate from each other automatically.

With the foregoing configuration, instead of exerting a downward biasing force, a simple push against the pressing button 14 is sufficient to make the hanging section 23 of the strip-holding member 2 completely leave the cut-away section 13 of the snorkel-holding member 1, thereby allowing the disengagement between the snorkel-holding member 1 and the strip-holding member 2 to be simpler and more convenient.

What is claimed is:

1. A fastening buckle for fastening a snorkel to swimming goggles (diving goggles), with the fastening buckle comprising a snorkel-holding member having a socket; a strip-holding member having an upper head portion engaged with the socket provided on the snorkel-holding member, with the upper head portion provided with a lower part thereof formed as a hanging section resiliently depressible and having a lower outer surface formed with an inclined plane, and with the snorkel-holding member including a gripping portion laterally formed with the socket receiving the upper head portion of the strip-holding member, wherein the socket has an outer wall formed with a cut-away section abutting against a bottom edge of the hanging section; and a resiliently depressible pressing button extending downward from a top of the socket, with the resiliently depressible pressing button hanging over the cut-away section and abutting against the inclined plane of the hanging section.

2. The fastening buckle of claim 1, wherein the strip-holding member further comprises a strip-positioning seat located at a lower end thereof and a pivotable strip-gripping arm located above the strip-positioning seat, wherein the strip-gripping arm has a fork-like lower end oppositely provided with two hooked pins facing the strip-positioning seat, and wherein the strip-holding member has a stepped retaining slot formed below the strip-positioning seat with the hooked pins inserted and retained therein.

* * * * *